US005512008A

United States Patent [19]

Musschoot

[11] Patent Number: 5,512,008

[45] Date of Patent: Apr. 30, 1996

[54] VIBRATORY TUMBLING APPARATUS

[75] Inventor: Albert Musschoot, Barrington, Ill.

[73] Assignee: General Kinematics Corporation, Barrington, Ill.

[21] Appl. No.: 97,976

[22] Filed: Jul. 27, 1993

[51] Int. Cl.[6] ..... B24B 31/06

[52] U.S. Cl. ..... 451/85; 451/86; 451/328

[58] Field of Search ..... 451/32, 34, 35, 451/85, 86, 326, 328

[56] References Cited

U.S. PATENT DOCUMENTS

| | | | |
|---|---|---|---|
| Re. 33,542 | 2/1991 | Musschoot . | |
| 3,157,004 | 11/1964 | Musschoot . | |
| 3,793,780 | 2/1974 | Musschoot | 51/417 |
| 4,011,976 | 1/1977 | Mac Millan | 51/418 |
| 4,254,592 | 3/1981 | Berna et al. | 51/423 |
| 4,665,655 | 5/1987 | Woodward | 51/5 R |
| 4,723,377 | 2/1988 | Watts | 51/411 |
| 4,731,959 | 3/1988 | Musschoot . | |
| 4,926,601 | 5/1990 | Musschoot . | |
| 5,095,968 | 3/1992 | Didion | 241/65 |

*Primary Examiner*—Maurina T. Rachuba
*Attorney, Agent, or Firm*—Wood, Phillips, VanSanten, Clark & Mortimer

[57] ABSTRACT

A vibratory material handling apparatus is provided for mixing of materials, cleaning, blending and/or shake out of castings or the like. The apparatus comprises a container having a material supporting surface disposed along a generally horizontal longitudinal axis. The container has a material input end and a material discharge end axially spaced therefrom and it is resiliently mounted relative to a mounting surface. The apparatus also includes a vibration generator for producing a force to cause material within the container to be directed in a path of tumbling movement generally in a direction from the material input end toward the material discharge end of the container. With this arrangement, a tumbling assist mechanism is provided for applying a force to the material in addition to the force produced by the vibration generator to facilitate tumbling of the material as it moves along the path of tumbling movement.

32 Claims, 3 Drawing Sheets

VIBRATORY TUMBLING APPARATUS

FIELD OF THE INVENTION

The present invention generally relates to vibratory apparatus and, in particular, to a vibratory tumbling apparatus for diverse materials and applications.

BACKGROUND OF THE INVENTION

As is known in the art, there are many diverse applications wherein materials are to be mixed, tumbled and/or blended. Similarly, there are many manufacturing processes which require the cleaning or shake-out of parts such as castings, moldings or bulk material, with or without a working media. For both types of applications, it is useful to utilize a tumbling apparatus to achieve the intended objective.

Some time ago, it was found that an improved finish could be obtained on cast or molded parts by adding a vibratory motion to a tumbling apparatus. For instance, in my earlier U.S. Pat. No. 3,157,004, an improved burnishing apparatus using a U-shaped tub mounted on trunnions was disclosed wherein vibratory force was applied directly to the tub such that the force passed through its center of gravity. When the U-shaped tub was tilted about the trunnions, the vibratory force was used for the purpose of discharging the media and parts from the tub.

Although improved burnishing of the parts resulted from this use of vibratory motion in a tumbling apparatus, problems continued with the balance of the machine. These included wear on bearings and the time it took to obtain the desired finish. To overcome such problems, a vibrating tumbling apparatus was conceived and developed as more fully disclosed and claimed in my earlier U.S. Pat. No. Re. 33,542.

According to that invention, a container is vibrated along small segments of an arcuate or circular path centered at a point offset from the center of the container. The material in the container is moved or conveyed and tumbled not only due to the coefficient of friction of the material with the surface of the container, but also due to the angle of attack between the material and the surface of the container at any given point because of the segmental circular path. While highly satisfactory tumbling action resulted from this improved arrangement, certain problems were discovered which required still further attention to more closely perfect the device.

In particular, my earlier U.S. Pat. No. Re. 33,542 taught that the inner surface of the container may be coated or lined. More specifically, this coating or lining was taught as comprising a material having a particular coefficient of friction which typically would comprise a material such as rubber or leather, which material was to aid in the conveying action and to improve the tumbling of the parts. In addition, the liner on the inner surface of the container was recognized as comprising a wear surface which could be replaced when worn.

Unfortunately, typical materials utilized because of their coefficient of friction usually have certain less than desirable physical characteristics. For instance, rubber or leather which is otherwise well suited for the intended purpose cannot withstand high temperatures and, thus, hot castings cannot immediately be treated in such a vibratory tumbling apparatus without the liner incurring substantial damage. Furthermore, depending upon the materials treated in the apparatus, the useful life of the liner is less than would normally be considered desirable.

In addition, in order to maximize the mixing, burnishing, blending etc., it is desirable for the material in the apparatus to be able to experience the best possible tumbling action. Thus, when the vibratory tumbling apparatus utilizes a generally horizontally arranged cylindrical container, it is desirable for the material to be vibrated upwardly along the inside surface of the container to the maximum extent possible before the material falls back by gravity to a lower point in the container. However, while conveying action is enhanced by utilizing a carefully selected liner, e.g., rubber or leather, it remained desirable to be able to convey the material to a still higher point.

To achieve this purpose, my earlier U.S. Pat. No. 4,926,601 taught the material supporting surface as having a plurality of generally circumferential, parallel troughs. These troughs were more specifically taught as being disposed about and spaced along the generally horizontal longitudinal axis of the curved or arcuate material supporting surface. While conveying material to a higher point is successfully achieved, it would remain desirable to be able to enhance the tumbling action of the material within the container.

The present invention is specifically directed to overcoming one or more of the foregoing problems and accomplishing one or more of the resulting objectives in a novel and efficient manner.

SUMMARY OF THE INVENTION

Accordingly, it is a principal object of the present invention to provide an improved vibratory tumbling apparatus having a material supporting surface for conveying material from one end of the apparatus to the other end thereof. It is a further object of the present invention to provide a vibratory tumbling apparatus in which material within a container is directed in a path of tumbling movement generally in a direction from a material input end toward a material discharge end thereof. Additionally, it is an object of the present invention to provide an improved vibratory tumbling apparatus having tumbling assist means for applying a force to material in addition to the force produced by vibration generating means associated therewith.

As a result, the present invention is directed to a vibratory apparatus comprising a container having a material supporting surface therewithin which is disposed along a generally longitudinal axis. The container has a material input end and a material discharge end axially spaced therefrom and is resiliently mounted relative to a mounting surface. The material within the container is directed in a path of tumbling movement in a direction from the material input end toward the material discharge end. The tumbling movement of the material is caused by a force on the container which is produced by vibration generating means acting on the container. Still additionally, the apparatus includes tumbling assist means for applying a force to the material in addition to the force produced by the vibration generating means to facilitate tumbling of the material as it moves along the path of tumbling movement.

In an exemplary embodiment of the invention, the tumbling assist means includes means for imparting kinetic energy to the material in a direction having a component generally perpendicular to a generally horizontal but downwardly inclined longitudinal axis. More specifically, the tumbling assist means advantageously includes a shot blast mechanism or a liquid jet mechanism for directing shot or liquid at the material. To facilitate the action of the tumbling assist means, the force produced by the vibration generating means causes movement of the material upwardly and forwardly relative to the container to create the path of tumbling movement thereof.

In addition, the apparatus preferably includes a generally horizontal base plate adjacent the curved material supporting surface and lying in a plane parallel to the generally horizontal but downwardly inclined longitudinal axis of the container. In this connection, and in one preferred form of the invention, the material advantageously includes media and parts to be tumbled in the container as the media and parts move through the container from the material input end to the material discharge end thereof.

In a most highly preferred embodiment, the container is a generally cylindrical drum, and it also has a generally horizontal but downwardly inclined longitudinal axis together with a center of gravity offset from the axis thereof. Preferably, the material supporting surface is curved or arcuate and is disposed entirely within the container, i.e., it either comprises the inner surface of the container or drum, or a separate surface positioned inwardly of the inside surface of the container or drum. With this arrangement, the vibration generating means advantageously produces vibratory forces directed along a linear path displaced not only from the generally longitudinal axis or axes but also from the center of gravity of the container or drum.

In this manner, the vibratory forces are such as to cause material within the container or drum to be moved in a direction upwardly and forwardly relative to the curved material supporting surface so as to be directed in the path of tumbling movement. This permits the tumbling assist means, which advantageously includes means for imparting kinetic energy to the material in a generally horizontal plane in a direction having a component generally perpendicular to the generally horizontal but downwardly inclined longitudinal axis of the curved material supporting surface, to impart kinetic energy to the material being conveyed. More specifically, a shot blast mechanism is advantageously provided for imparting a force through the kinetic energy of shot directed at the material in a generally horizontal plane within a preselected arc from at least one location as the material moves along the path of movement therefor.

In a most highly preferred embodiment, the vibratory apparatus includes a plurality of shot drop holes within the base plate and a discharge opening in the bottom portion or at the bottom of the cylindrical container or drum and a shot conveyor disposed beneath the discharge opening externally of the cylindrical conveyor or drum. Preferably, the shot conveyor extends from a point adjacent the cylindrical container or drum to shot separator means in communication with the shot blast mechanism for separating, e.g., sand and broken shot from reusable shot.

In this connection, the kinetic energy of the shot from the shot blast mechanism or, alternatively, liquid from a liquid jet mechanism forces the material against the curved material supporting surface as the vibration generating means forces the material upwardly and forwardly to produce a turnover action. In one highly advantageous application, the material includes sand and castings to be tumbled within the container as the sand and castings move through the container from the material input end to the material discharge end thereof. For this application, the turnover action causes all surfaces of the castings to be exposed to the shot for treatment as the castings move from the input end to the discharge end of the container.

In a most highly preferred embodiment of the invention, the linear path of vibratory forces passes on the side of the center of gravity remote from the generally horizontal but downwardly inclined longitudinal axis of the cylindrical container or drum to cause each point on the curved material supporting surface to rotate along a path lying on a segment of a circle. The segments of circles have a center of rotation located at a position displaced from the generally horizontal but downwardly inclined longitudinal axis and on the side thereof remote from the center of gravity so that segments of circles do not conform to the curved material supporting surface. Preferably, each of the segments of circles has a center of rotation on the other side of the generally horizontal but downwardly inclined longitudinal axis from the center of gravity of the cylindrical container or drum and, the center of rotation lies on a line extending normal to the linear path and passing through the center of gravity of the cylindrical container or drum.

Still additional objects, advantages and features of the present invention will become apparent from a consideration of the following specification taken in conjunction with the accompanying drawings.

DETAILED DESCRIPTION OF THE PREFERRED EMBODIMENT

Figure 1:
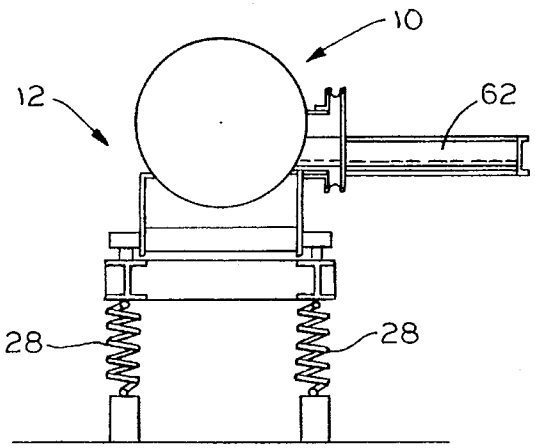
FIG. 1 is an end elevational view of a vibratory tumbling apparatus in accordance with the present invention.
Figure 2:
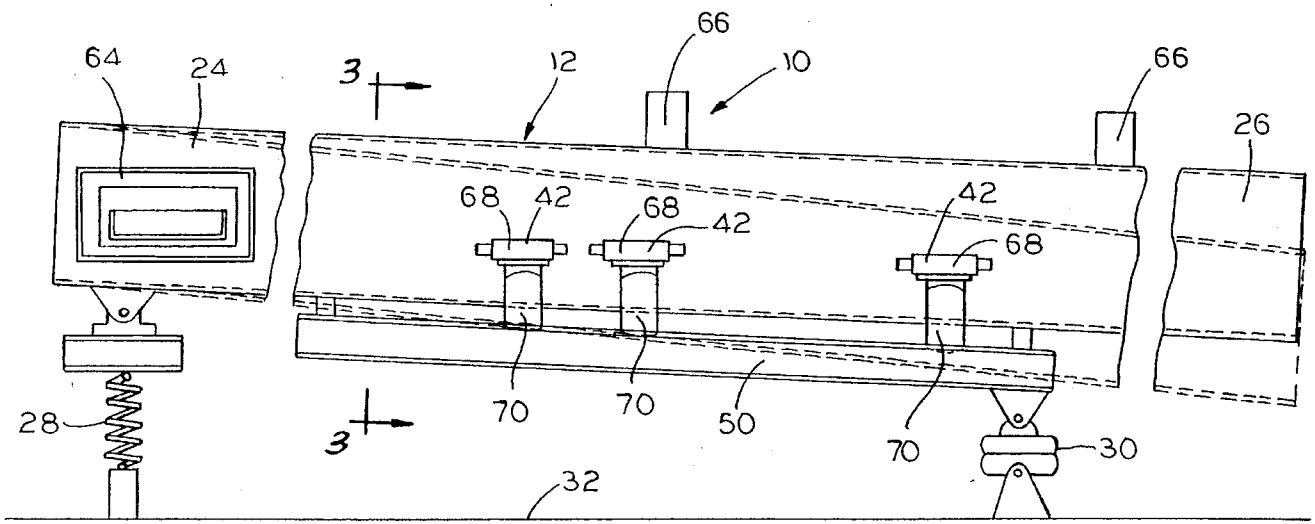
FIG. 2 is a front elevational view of the vibratory tumbling apparatus in accordance with the present invention as illustrated in FIG. 1.
Figure 3:
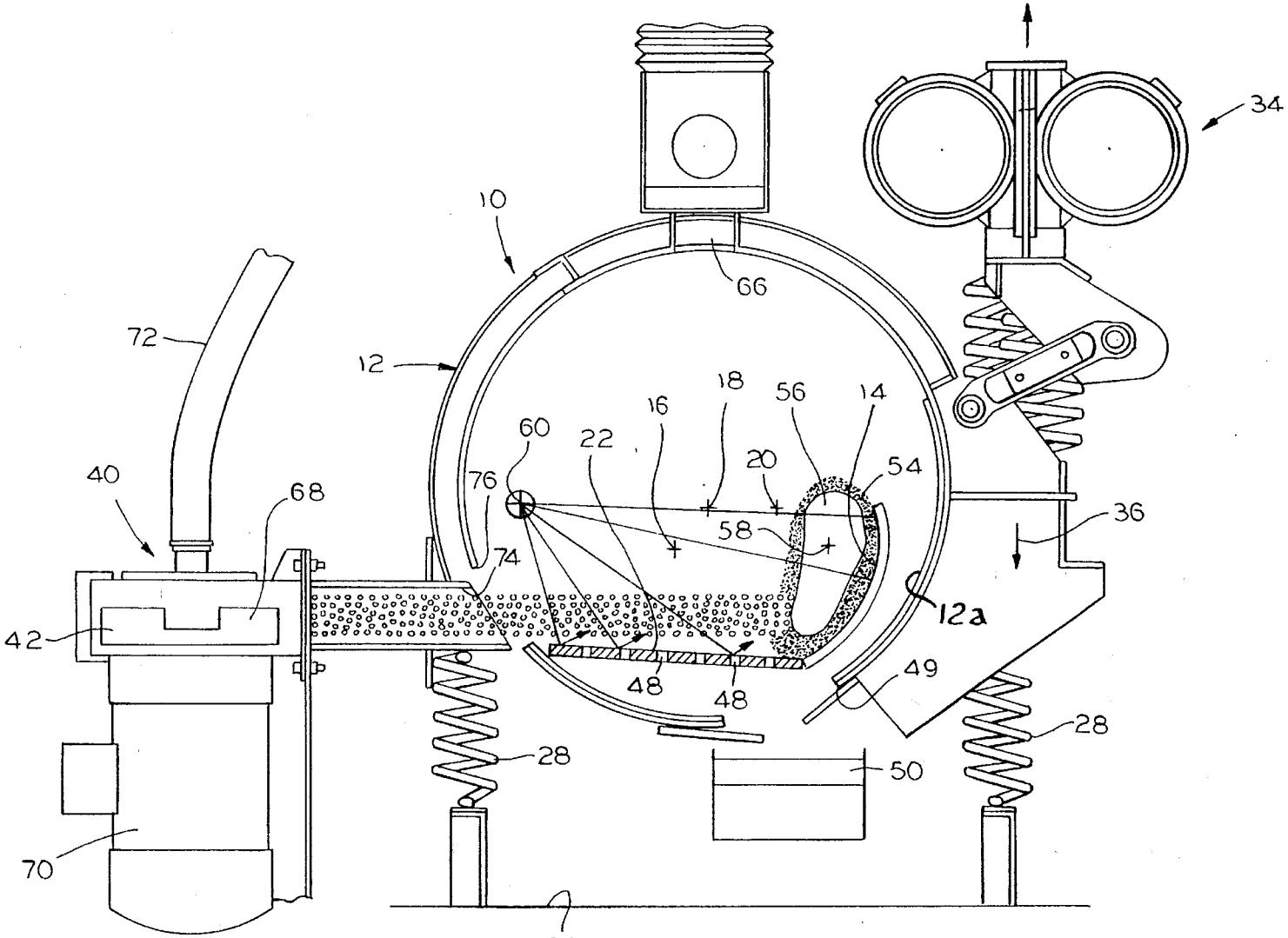
FIG. 3 is a cross-sectional view of the vibratory tumbling apparatus in accordance with the present invention taken on the line 3—3 of FIG. 2.

Referring to the drawings, and first to FIGS. 1 through 3, the reference numeral 10 designates generally a vibratory tumbling apparatus in accordance with the present invention. The apparatus 10 includes a container 12 having a material supporting surface 14 therewithin, curved in the illustrated embodiment, which is disposed along a generally longitudinal axis 16. The container 12 is preferably generally cylindrical in shape, i.e., it is generally in the shape of a drum, and it also has a generally longitudinal axis 18 which is offset from the generally longitudinal axis 16 of the material supporting surface 14 as well as a center of gravity 20 which is likewise offset from the generally longitudinal axis 18. The curved material supporting surface 14 is disposed entirely within the generally cylindrical container or drum 12, and a generally horizontal base plate 22 is positioned adjacent the curved material supporting surface 14 to lie in a plane extending parallel to the generally longitudinal axis 18 of the container. As best shown in FIG. 2, the vibratory tumbling apparatus 10 is such that the container 12 has a material input end 24 and a material discharge end 26 axially spaced therefrom.

As best shown in FIGS. 2 and 3, the vibratory tumbling apparatus 10 includes means such as springs 28 and 30 for resiliently mounting the container 12 relative to a mounting surface 32 (see, also, FIG. 2). It will also be seen that vibration generating means generally designated 34 (FIG. 3) is provided for producing vibratory forces directed along a linear path 36 displaced not only from the generally longitudinal axes 16 and 18 of the support surface 14 and the container 12, respectively, (which are generally horizontal but downwardly inclined in the preferred embodiment) but also from the center of gravity 20 of the container 12 which causes material within the container to be moved upwardly and forwardly relative to the curved material supporting surface 14. In this manner, the material is directed in a path of tumbling movement generally in a direction from the material input end 24 toward the material discharge end 26 of the container 12 as represented by arrows 38 in FIG. 4.

Figure 4:
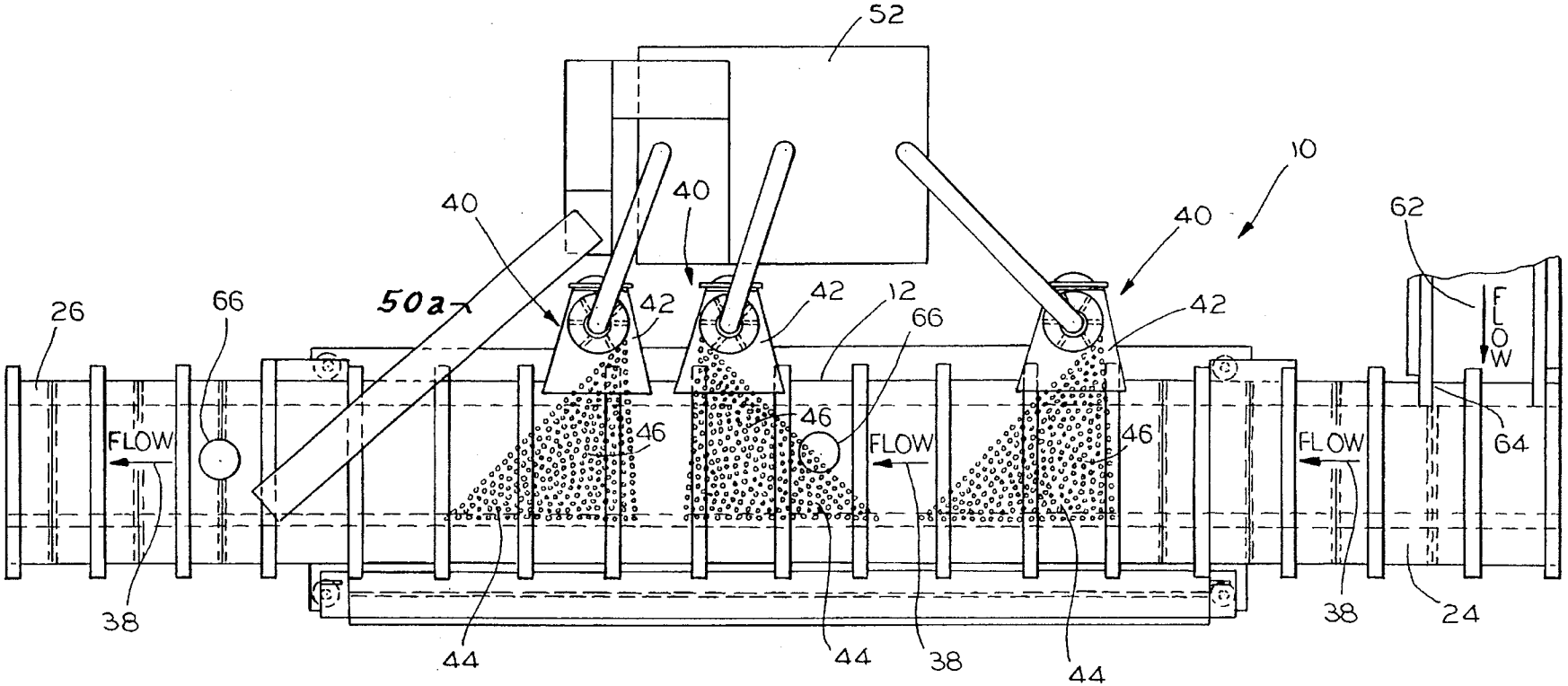
FIG. 4 is a top plan view of the vibratory tumbling apparatus in accordance with the present invention as illustrated in FIG. 1.

Referring now specifically to FIGS. 3 and 4, the vibratory tumbling apparatus 10 will be seen to include tumbling assist means generally designated 40 for applying a force to the material in addition to the force produced by the vibration generating means 34 to facilitate tumbling of the material as it moves along the path of tumbling movement. The tumbling assist means preferably comprises means for imparting kinetic energy to the material in a generally horizontal plane (see, also, FIG. 1) which plane will be seen to be generally parallel to the generally horizontal but downwardly inclined longitudinal axis 16 of the curved material supporting surface 14. In particular, the kinetic energy imparting means advantageously includes one or more shot blast mechanisms 42 for directing shot at the material in a pattern such as 44 in a generally horizontal plane within a preselected arc 46 from at least one location as the material moves along the path of movement represented by arrows 38 in FIG. 4.

As will be appreciated, the shot in the pattern 44 is projected or thrown so as to have at least a major component extending generally perpendicular to but offset from the direction of the longitudinal axes 16 and 18 of the support surface 14 and a container 12, respectively.

Alternatively, and while not specifically shown, it will be understood that the kinetic energy imparting means can take the form of one or more liquid jet mechanisms for spraying a jet stream of liquid at the material instead of the shot pattern for certain applications where it is particularly advantageous to treat the material with a liquid while at the same time imparting kinetic energy thereto.

Referring to FIG. 3, the vibratory tumbling apparatus 10 will be understood to include a plurality of shot drop holes 48 in the base plate 22 and a discharge opening 49 in the bottom portion, i.e., at or near the bottom of the cylindrical container 12 and a shot conveyor 50 is disposed beneath the discharge opening 49 externally of the cylindrical container 12. Referring now to FIG. 4, the shot conveyor 50 advantageously includes at least one portion **50*a* extending from the cylindrical container 12 to shot separator means generally designated 52 which is in communication with one or more shot blast mechanisms 42** for separating, e.g., sand and broken shot from reusable shot.

In a most highly advantageous application of the present invention, the material includes sand 54 and castings 56 (FIG. 3) to be tumbled within the container 12 as the sand 54 and castings 56 move through the container 12 from the material input end 24 to the material discharge end 26 thereof. As will be appreciated, the castings 56 climb upwardly and forwardly relative to the curved material supporting surface 14 where they are hit by shot directed as at 44 from the shot blast mechanism 42 to strike the castings generally at a point below their center of gravity 58 to thereby significantly facilitate the tumbling action thereof.

In this connection, the kinetic energy of the shot from the shot blast mechanism 42 (or, alternatively, liquid from a liquid jet mechanism) forces the castings 56 against the curved material supporting surface 14 as the vibration generating means 34 forces the castings 56 upwardly and forwardly to produce a turnover action. For castings applications, the turnover action which is produced by the combined action of the vibration generating means 34 and the shot blast mechanisms 42 causes all surfaces of the castings 56 to be exposed to the shot for treatment as the castings move from the input end 24 to the discharge end 26 of the container 12.

With reference to FIG. 3, the linear path of vibratory forces 36 passes on the side of the center of gravity 20 of the container 12 remote from the longitudinal axis 18 of the container 12 of the cylindrical container 12 to cause each point on the curved material supporting surface 14 to rotate along a path lying on a segment of a circle. Each of the segments of circles has a center of rotation as at 60 located at a position displaced from the generally longitudinal axis 18 and on the side thereof remote from the center of gravity 20 so that segments of circles do not conform to the curved material supporting surface 14. Still additionally, the center of rotation 60 of each of the segments of circles will be seen and understood to lie on a line which extends generally normal to the linear path 36 of the vibratory forces and which passes through the center of gravity 20 of the cylindrical container 12.

As for other details of the vibratory tumbling apparatus 10, the resilient mounting means or springs 28 and 30 preferably mount the cylindrical container 12 for unconstrained vibratory movement. It will also be seen from FIG. 2 that the springs such as 30 at one end of the cylindrical container 12 advantageously take the form of pneumatic springs of a type that will be known to those skilled in the art. These springs 30 may be inflated and deflated to change the elevation or pitch of the material discharge end 26 of the cylindrical container 12 in relation to the material input end 24. It is thus possible to position the cylindrical container 12 to have the longitudinal axes 16 and 18 of the surface 14 and the container 12, respectively, downwardly inclined relative to the horizontal. Thus, generally speaking, the material discharge end 26 of the cylindrical container 12 will be at a lower elevation to facilitate the flow of material from the input end 24 toward the discharge end 26.

As shown in FIGS. 1, 2 and 4, the vibratory tumbling apparatus 10 may suitably include a conveyor as at 62 for delivering the sand 54 and the castings 56 (FIG. 3) into the cylindrical container 12 through a material receiving window or port 64. There may also be provided at the opposite, material discharge end 26 of the cylindrical container 12 a suitable window or port such as those illustrated in my earlier U.S. Pat. Nos. Re. 33,542 and 4,926,601 for conveying discharged sand 54 and/or castings 56 away from the vibratory tumbling apparatus 10. As an alternative that may be suitable for certain applications, it will be understood that the discharge or outlet window or port could be located for the passage of sand and/or castings through the low point of the cylindrical container 12.

Referring to FIG. 3, it will be seen that the vibratory tumbling apparatus 10 may advantageously be formed for certain applications so as to include one or more vacuum exhaust ports 66. The exhaust ports 66 will typically be provided at the top of the generally cylindrical container 12 and, as shown in FIG. 4, there may advantageously be provided one of such ports at a mid point along the container 12 and another near the material discharge end 26 thereof. As will be appreciated, the exhaust ports 66 will be operatively associated with a vacuum system for removing dust caused by tumbling of, e.g., sand 54 and castings 56 within the container 12.

In the preferred embodiment, the apparatus 10 is constructed so that at least the curved material supporting surface 14 and the base plate 22 are plated with manganese. This is done in order to provide adequate resistance to the impact of deflected shot which makes contact with these components. Advantageously, the inner surface of the cylindrical container 12 is also plated with manganese at least in the region generally designated 12*a* to accomplish this same objective.

As for details of the shot blast mechanism 42, it will be seen that these devices may take the form of a wheel 68 driven by a motor 70 where shot is fed through a tube 72 (FIG. 3) from the shot separator mechanism 52. The particular type of shot blast mechanism 4.2 is not critical, although it has been found that the mechanism sold under the registered trademark Wheelabrator Super II Turnblast by Wheelabrator-Frye, Inc. of Mishawaka, Ind. is highly advantageous. With this type of shot blast mechanism 42, the shot blast arc as at 46 may be preselected and varied depending upon the particular application and the head of shot within the tube 72 may be controlled.

As for the shot separator mechanism 52, it may be of a type operable to achieve either magnetic or air separation of broken shot and shot pieces as well as sand that is conveyed to the shot separator mechanism 52 by the shot conveyor portion 50*a* and, again, can be of the type commonly sold by Wheelabrator-Frye, Inc. of Mishawaka, Ind.

As will be appreciated by comparing FIGS. 3 and 4, the shot blast mechanisms 42 will typically each include a port 74 which is in direct communication with an opening 76 extending through the side of the cylindrical container 12. The opening 76 extends from a lowermost point generally at the height of the generally horizontal base plate 22 to a point circumferentially spaced thereabove. In this manner, the shot blast mechanisms 42 may direct shot at the sand 54 and castings 56 at a point below the center of gravity 58 of the castings 56 as they climb upwardly and forwardly on the curved material supporting surface 14.

As for the operation of the vibration generating means 34 and all other common aspects of the present invention with my earlier work, the teachings of my earlier U.S. Pat. Nos. Re. 33,542 and 4,926,601 are hereby expressly incorporated herein by reference.

With the present invention, it is possible to feed working media and/or parts such as hot sand 54 and castings 56 directly into the cylindrical container 12 such that there need be no interruption in time following a casting process. On the contrary, the cast products as well as the surrounding media (sand) can all be further processed in the container 12 without any delay for cooling or the like. In addition, by utilizing a shot blast mechanism 42, the tumbling and turnover action is significantly enhanced as is treatment of all of the surfaces of the castings 56.

In other words, and by utilizing the shot blast mechanism 42 in combination with the vibratory tumbling apparatus 10 as described hereinabove, it has been found that the cleaning and burnishing of the castings 56 are also significantly enhanced. Thus, while my earlier U.S. Pat. Nos. Re. 33,542 and 4,926,601 represented significant advances in the art, the present invention still further advances the art by imparting kinetic energy to material such as sand and castings in a generally horizontal plane generally parallel to the axis of the curved material supporting surface 14 and the direction of travel of the material. In other words, the force supplied by the shot blast mechanisms 42 to the material such as sand and castings cooperates with the force produced by the vibration generating means 34 to facilitate tumbling as the sand and castings move along the path of tumbling movement.

While in the foregoing there has been set forth a preferred embodiment of the invention, it will be understood and appreciated that the invention is only to be limited by the true spirit and scope of the appended claims.

I claim:

1. A vibratory apparatus, comprising:

a container having a material supporting surface disposed along a generally longitudinal axis and extending from a first position to a second, higher position within said container;

said container having a material input end and a material discharge end, said material input end being axially spaced from said material discharge end, and including means for resiliently mounting said container relative to a mounting surface;

vibration generating means for producing a force to cause material within said container to be directed in a path of tumbling movement generally in a direction from said material input end toward said material discharge end of said container; and tumbling assist means for applying an additional force to said material in addition to said force produced by said vibration generating means said tumbling assist means applying said additional force to said material predominantly at a location below the center of gravity of the material to facilitate tumbling of said material as it moves along said path of tumbling movement.

2. The vibratory apparatus of claim 1 wherein said tumbling assist means includes means for imparting kinetic energy to said material in a direction having a component generally perpendicular to said generally longitudinal axis.

3. The vibratory apparatus of claim 1 wherein said tumbling assist means includes a shot blast mechanism for directing shot at said material so as to have a component generally perpendicular to said generally longitudinal axis.

4. The vibratory apparatus of claim 1 wherein said tumbling assist means includes a liquid jet mechanism for directing liquid at said material so as to have a component generally perpendicular to said generally longitudinal axis.

5. The vibratory apparatus of claim 1 wherein said force produced by said vibration generating means causes movement of said material upwardly and forwardly to create said path of tumbling movement thereof.

6. The vibratory apparatus of claim 1 including a generally horizontal base plate adjacent said material supporting surface and lying in a plane parallel to said generally longitudinal axis of said container.

7. The vibratory apparatus of claim 1 wherein said material includes media and parts to be tumbled in said container as said media and parts move from said material input end to said discharge end thereof.

8. A vibratory apparatus, comprising:

a container having a curved material supporting surface therewithin disposed along a generally horizontal but downwardly inclined longitudinal axis;

said container having a material input end and a material discharge end, said material input end being axially spaced from said material discharge end, and including means for resiliently mounting said container relative to a mounting surface;

vibration generating means for producing a force to cause material within said container to be moved upwardly and forwardly relative to said curved material supporting surface so as to be directed in a path of tumbling movement generally in a direction from said material input end toward said material discharge end of said container; and tumbling assist means for applying a force to said material in addition to said force produced by said vibration generating means to facilitate tumbling of said material as it moves along said path of tumbling movement, said tumbling assist means including means for imparting kinetic energy to said material at a location and in a direction displaced from the center of gravity of the material and in a direction having a component generally perpendicular to said generally horizontal but downwardly inclined longitudinal axis.

9. The vibratory apparatus of claim 8 wherein said tumbling assist means includes a shot blast mechanism for directing shot at said material from at least one location as said material moves along said path of movement therefor.

10. The vibratory apparatus of claim 8 wherein said tumbling assist means includes a liquid jet mechanism for directing liquid at said material so as to have a component generally perpendicular to said generally longitudinal axis.

11. The vibratory apparatus of claim 9 including a generally horizontal base plate adjacent said material supporting surface in a plane parallel to said generally horizontal but downwardly inclined longitudinal axis.

12. The vibratory apparatus of claim 11 wherein said material includes sand and castings to be tumbled in said container during movement through said container from said material input end to said discharge end thereof.

13. The vibratory apparatus of claim 8 wherein said container is generally cylindrical and said curved material supporting surface is disposed entirely within said generally cylindrical container.

14. The vibratory apparatus of claim 8 wherein said generally cylindrical container has at least one vacuum exhaust port at the top thereof for removing dust caused by tumbling of said material within said container.

15. The vibratory apparatus of claim 14 wherein said material includes sand and castings to be tumbled in said container during movement through said container from said material input end to said discharge end thereof.

16. A vibratory apparatus, comprising:

a container having a curved material supporting surface therewithin, said material supporting surface being disposed along a generally horizontal but downwardly inclined longitudinal axis and said container being generally cylindrical and also being disposed along a generally horizontal but downwardly inclined longitudinal axis, said material supporting surface being disposed entirely within said container;

said container also having a generally horizontal base plate adjacent said curved material supporting surface and lying in a plane parallel to said generally horizontal but downwardly inclined longitudinal axis of said container;

said container having a material input end and a material discharge end, said material input end being axially spaced from said material discharge end, and including means for resiliently mounting said container relative to a mounting surface;

vibration generating means for producing a force to cause material within said container to be moved upwardly and forwardly relative to said curved material supporting surface so as to be directed in a path of tumbling movement generally in a direction from said material input end toward said material discharge end of said container; and tumbling assist means for applying a force to said material in addition to said force produced by said vibration generating means to facilitate tumbling of said material as it moves along said path of tumbling movement, said tumbling assist means including means for imparting kinetic energy to said material in a generally horizontal plane in a direction having a component generally perpendicular to said generally horizontal but downwardly inclined longitudinal axis of said curved material supporting surface, said kinetic energy imparting means including a shot blast mechanism for directing shot at said material in a generally horizontal plane within a preselected arc from at least one location as said material moves along said path of movement therefor, said kinetic energy of said shot blast mechanism forcing said material against said curved material supporting surface as said vibration generating means forces said material upwardly and forwardly to produce a turnover action;

said material including sand and castings to be tumbled within said container as said sand and castings move through said container from said material input end to said material discharge end thereof, said turnover action causing all surfaces of said castings to be exposed to said shot for treatment as said castings move from said input end to said discharge end of said container.

17. The vibratory apparatus of claim 16 wherein said generally cylindrical container has at least one vacuum exhaust port at the top thereof for removing dust caused by tumbling of said sand and castings within said container.

18. The vibratory apparatus of claim 16 including a plurality of shot drop holes within said base plate, a shot discharge opening in the bottom portion of said container and a shot conveyor disposed beneath said shot discharge opening externally of said container.

19. The vibratory apparatus of claim 18 wherein said shot conveyor extends from said cylindrical container to shot separator means in communication with said shot blast mechanism for separating sand and broken shot from reusable shot.

20. The vibratory apparatus of claim 16 wherein at least said curved material supporting surface and said generally horizontal base plate are plated with manganese to resist the impact of deflected shot making contact therewith.

21. The vibratory apparatus of claim 16 wherein the inner surface of said cylindrical container is plated with manganese to resist the impact of deflected shot from said shot blast mechanism making contact therewith.

22. The vibratory apparatus of claim 16 including a plurality of shot blast mechanisms longitudinally spaced along said cylindrical container with each of said shot blast mechanisms including a shot blast wheel driven by a motor.

23. A vibratory apparatus, comprising:

a container having a curved material supporting surface disposed along a generally horizontal but downwardly inclined longitudinal axis, said container being a cylindrical drum disposed along a generally horizontal but downwardly inclined longitudinal axis and having a center of gravity offset therefrom, said curved material supporting surface being disposed entirely within said cylindrical drum;

said cylindrical drum also having a generally horizontal base plate adjacent said curved material supporting surface in a plane parallel to said generally horizontal but downwardly inclined longitudinal axis of said cylindrical drum;

said cylindrical drum having a material input end axially spaced from a material discharge end thereof, and including means for resiliently mounting said cylindrical drum relative to a mounting surface;

vibration generating means for producing vibratory forces directed along a linear path displaced not only from said generally longitudinal axes but also from said center of gravity of said cylindrical drum to cause material within said container to be moved upwardly and forwardly relative to said curved material supporting surface so as to be directed in a path of tumbling movement generally in a direction from said material input end toward said material discharge end of said cylindrical drum; and tumbling assist means for applying a force to said material in addition to said force produced by said vibration generating means to facilitate tumbling of said material as it moves along said path of tumbling movement, said tumbling assist means including means for imparting kinetic energy to said material in a generally horizontal plane in a direction having a component generally perpendicular to said generally horizontal but downwardly inclined longitudinal axis of said curved material supporting surface, said kinetic energy imparting means including a shot blast mechanism for directing shot at said material in a generally horizontal plane within a preselected arc from at least one location as said material moves along said path of movement therefor;

a plurality of shot drop holes within said base plate and a discharge opening in said cylindrical drum at the bottom thereof and a shot conveyor disposed beneath said discharge opening externally of said cylindrical drum, said shot conveyor extending from said cylindrical drum to shot separator means in communication with said shot blast mechanism for separating sand and broken shot from reusable shot;

said material including sand and castings to be tumbled within said cylindrical drum as said sand and castings move through said cylindrical drum from said material input end to said material discharge end thereof.

24. The vibratory apparatus of claim 23 wherein said linear path of vibratory forces passes on the side of said center of gravity remote from said generally horizontal but downwardly inclined longitudinal axis of said cylindrical drum to cause each point on said curved material supporting surface to rotate along a path lying on a segment of a circle.

25. The vibratory apparatus of claim 24 wherein each of said segments of circles has a center of rotation located at a position displaced from said generally horizontal but downwardly inclined longitudinal axis and on the side thereof remote from said center of gravity so that said segments of circles do not conform to said curved material supporting surface.

26. The vibratory apparatus of claim 24 wherein each of said segments of circles has a center of rotation on the other side of said generally horizontal but downwardly inclined longitudinal axis from said center of gravity of said cylindrical drum and lying on a line extending normal to said linear path and passing through said center of gravity of said cylindrical drum.

27. The vibratory apparatus of claim 23 wherein said resilient mounting means mounts said cylindrical container for unconstrained vibratory movement.

28. A vibratory tumbling apparatus comprising:

means defining a material receiving surface having spaced side edges;

one of said side edges being elevated above the other side edge such that at least part of said material receiving surface is inclined from the other side edge to said one edge;

means for imparting vibratory motion to said material receiving surface defining means so as to cause material on said material receiving surface to move up said inclined part of said material receiving surface to tumble thereon; and means for impinging a stream on material on said material receiving surface such that said stream imparts a force in addition to that of said vibratory motion imparting means to said material urging said material to move up said inclined part of said material receiving surface to tumble thereon.

29. The vibratory tumbling apparatus of claim 28 wherein said means defining an elongated material receiving surface includes a base plate and an adjacent curved surface, said curved surface being said inclined part of said material receiving surface.

30. The vibratory tumbling apparatus of claim 28 wherein said impinging means comprises a shot blast mechanism.

31. The vibratory tumbling apparatus of claim 28 wherein said impinging means comprises a liquid jet mechanism.

32. The vibratory tumbling apparatus of claim 29 wherein said impinging means directs said stream generally along and above said base plate.

* * * * *